US006512496B2

(12) United States Patent
Alexeff et al.

(10) Patent No.: US 6,512,496 B2
(45) Date of Patent: Jan. 28, 2003

(54) EXPANDIBLE ANTENNA

(75) Inventors: Igor Alexeff, Oak Ridge, TN (US); Ted Anderson, Niskayuna, NY (US); Elwood G. Norris, Poway, CA (US)

(73) Assignee: ASI Technology Corporation, Henderson, NV (US)

( * ) Notice: Subject to any disclaimer, the term of this patent is extended or adjusted under 35 U.S.C. 154(b) by 0 days.

(21) Appl. No.: 09/764,801

(22) Filed: Jan. 17, 2001

(65) Prior Publication Data

US 2002/0093460 A1 Jul. 18, 2002

(51) Int. Cl.[7] ..... H01Q 15/20

(52) U.S. Cl. ..... 343/915; 343/878; 343/880; 343/881

(58) Field of Search ..... 343/878, 879, 343/880, 881, 893, 788, 915

(56) References Cited

U.S. PATENT DOCUMENTS

| | | | | | |
|---|---|---|---|---|---|
| 2,913,726 | A | | 11/1959 | Currie et al. | 343/872 |
| 3,005,987 | A | | 10/1961 | Mack et al. | 343/872 |
| 3,115,631 | A | | 12/1963 | Martin | 343/18 |
| 3,130,406 | A | | 4/1964 | Jones-Hinton et al. | 343/18 |
| 3,170,471 | A | | 2/1965 | Schnitzer | 135/1 |
| 3,176,302 | A | | 3/1965 | Tipton | 343/872 |
| 3,737,912 | A | * | 6/1973 | Cribb | 343/880 |
| 3,811,127 | A | | 5/1974 | Griffee et al. | 343/705 |
| 4,475,109 | A | | 10/1984 | Dumas et al. | 343/709 |
| 4,672,389 | A | * | 6/1987 | Ulry | 343/915 |
| 4,755,819 | A | | 7/1988 | Bernasconi et al. | 343/915 |
| 5,003,514 | A | | 3/1991 | Cotilla et al. | 367/4 |
| 5,132,699 | A | | 7/1992 | Rupp et al. | 343/880 |
| 5,166,696 | A | | 11/1992 | Rupp et al. | 343/711 |
| 5,406,294 | A | | 4/1995 | Silvey et al. | 343/709 |
| 5,734,353 | A | * | 3/1998 | Van Voorhies | 343/742 |
| 5,739,738 | A | | 4/1998 | Hansen et al. | 336/229 |
| 5,984,385 | A | * | 11/1999 | Shtarkman et al. | 292/251.5 |
| 5,990,851 | A | | 11/1999 | Henderson et al. | 343/915 |
| 6,115,003 | A | * | 9/2000 | Kozakoff | 343/840 |

FOREIGN PATENT DOCUMENTS

| | | | | |
|---|---|---|---|---|
| JP | 2000323919 | * | 11/2000 | H01Q/15/20 |

* cited by examiner

*Primary Examiner*—Don Wong
*Assistant Examiner*—Shih-Chao Chen
(74) *Attorney, Agent, or Firm*—Thorpe North & Western

(57) ABSTRACT

An expandible antenna device comprising an expandible shell defining an interior chamber, wherein the shell is radially expandible from a central axis within the chamber; an elongated support structure disposed along the central axis and at least partially within the chamber; and an antenna element coupled to the shell such that the antenna is dimensionally stable when the shell is in an expanded position is disclosed. Additionally, an antenna element comprised of conductive elements joined by fluid filled bulbs or tubes wherein the fluid is capable of ionization is also disclosed.

54 Claims, 4 Drawing Sheets

EXPANDIBLE ANTENNA

FIELD OF THE INVENTION

The present invention is drawn to an expandible antenna.

BACKGROUND OF THE INVENTION

Traditionally, antennas have been defined as metallic devices for radiating or receiving radio waves. Therefore, the paradigm for antenna design has traditionally been focused on antenna geometry, physical dimensions, material selection, electrical coupling configurations, multi-array design, and/or electromagnetic waveform characteristics such as transmission wavelength, transmission efficiency, transmission waveform reflection, etc. As such, technology has advanced to provide many unique antenna designs for applications ranging from general broadcast of RF signals to weapon systems of a highly complex nature.

Conductive wire antennas are generally sized to emit radiation at one or more selected frequencies. To maximize effective radiation of such energy, the antenna is adjusted in length to correspond to a resonating multiplier of the wavelength of frequency to be transmitted. Accordingly, typical antenna configurations will be represented by quarter, half, and full wavelengths of the desired frequency.

Efficient transfer of RF energy is achieved when the maximum amount of signal strength sent to the antenna is expended into the propagated wave, and not wasted in antenna reflection. This efficient transfer occurs when the antenna length is an appreciable fraction of transmitted frequency wavelength. The antenna will then resonate with RF radiation at some multiple of the length of the antenna. Due to this traditional length requirement, rigid metal antennas can be somewhat limited in breadth as to the frequency bands that they may radiate or receive. Frequency bands representing long wavelengths necessitate large antennas which are especially limited in mobility.

Supports for antennas have also evolved over time. Inflatable structures have been effectively used to suspend and support radar reflectors and antennas in various environments. For example, an inflatable radar reflector incorporated within a life raft has been described in U.S. Pat. No. 3,130,406. Specifically, this patent discloses a circular sheet of flexible material having at least one circular central section reflective of radio waves and an inflatable endless tube which encircles the sheet to hold the center section taut and flat when the tube is inflated.

U.S. Pat. No. 4,475,109 discloses an inflatable antenna for use with a buoy at sea that provides hemispherical coverage including sufficient gain at the horizon. The inflatable compartment contains webs that are metalized to form the feed portions of the radiating elements. Additionally, areas of the top inner surface of the inflatable compartment are also metalized to form capacitive loading portions of the radiating elements. A ground is formed by conductive inner and outer surfaces of the bottom of the inflatable compartment which are coupled to the sea water.

Inflatable antennas have also been used to support land radar antennas and reflectors for radio waves. Such an antenna was disclosed in U.S. Pat. No. 2,913,726. Specifically, this patent discloses an inflatable antenna structure that comprises two paraboloids joined at their rims to form an inflatable housing. The housing is supported in an upright position on a rotatable base. One of the paraboloids has its inner surface coated with reflective material so that when the housing is inflated, the coated paraboloid assumes the configuration of a parabolic antenna reflector.

U.S. Pat. No. 3,005,987 discloses an inflatable antenna assembly comprising an elliptical tubular member having sheets of flexible nonconducting material fastened to opposite sides of the tube to form an enclosure.

U.S. Pat. No. 3,115,631 discloses an inflatable reflector for radio waves comprising a base of double pile textile fabric having outer sheets which are rendered substantially impermeable to gas and are tied together in a parallel-spaced relation by pile threads. The threads are woven through the fabric and form a chamber which can be inflated. Upon inflation, sheets of flexible radio reflecting material which are secured therein become taut and held flat in a mutually perpendicular relation.

U.S. Pat. No. 3,170,471 discloses an inflatable honeycomb element for use in making up structures which are foldable and inflatable. The element comprises a collapsible, inflatable structure which has flexible outer skin members and flexible inner core members which are perpendicularly disposed to divide the element into a plurality of cells. The panel structure may be fabricated of a thin, lightweight flexible plastic film or sheet which may further have a thin layer of metal placed thereon to strengthen the plastic and to reflect the light and radio wave.

U.S. Pat. No. 3,176,302 discloses an inflatable variable band with antenna having an inflatable tubular ring which supports a flexible diaphragm. The diaphragm comprises nonconductive fabric and parallel, spaced elastic flexible conductive strips secured by their ends to the periphery of the housing.

U.S. Pat. No. 3,811,127 discloses an antenna suitable for airborne satellite communications. That antenna has four metal blades orthogonally positioned on a support base, which includes a ground plane. Each blade has at the upper edge thereof a metal capacitive loading portion which is formed roughly into the shape of a section of a sphere. The capacitive loading portions define at least approximately a spherical section.

U.S. Pat. No. 5,132,699 discloses a collapsible antenna formed of one or more generally planar and vertically inclined inflatable panels. Each of the panels has a continuous outer wall, a continuous inner wall, and a plurality of web partitions extending between the inner and outer walls to form a series of tubular members. The inner wall of the collapsible antenna is at least partially covered by a metallic material and a plurality of dipole elements are affixed to the web partitions and spaced from the inner wall in a predetermined relationship such that the antenna will operate at a preselected frequency when inflated.

U.S. Pat. No. 5,739,738 discloses an inflatable high Q toroidal inductor which is fabricated from a flexible toroidal-shaped shell. The shell is coupled to a source of pressurized gas which inflates the flexible shell to assume a toroidal shape. One or two flexible annular bands are secured at intervals to the toroidal shell to hold at least one flexible inductor in a toroidal-shaped winding configuration on the toroidal-shaped shell. The inductor itself is preferably comprised of flexible litz wire windings that are held in place by flexible bands on the inside and outside of the inflated toroidal-shaped shell.

Though some of the aforementioned patents describe various types of inflatable antennas, none describe a radially expandible antenna apparatus (and associated method) as disclosed or claimed hereafter that allows for rapid deployment and retraction as would be desirable for use with submarines and/or other underwater vessels. Thus, it would be useful to provide such an apparatus and associated method.

SUMMARY OF THE INVENTION

The present invention is drawn to an expandable antenna device comprising an expandible shell defining an interior chamber, wherein the shell is radially expandible from a compacted configuration with respect to a central axis within the chamber. An elongated support structure is disposed along the central axis and at least partially within the chamber. An antenna element is coupled to the shell such that the antenna is dimensionally stable when the shell is in an expanded position for operation. Any type of antenna that is flexible, pivotable, retractactable, expandible, etc., can be used. In one embodiment, the antenna element can be comprised of two conductive elements, and a fluid, e.g., gas or vapor, filled bulb or tube wherein the fluid is capable of ionization positioned between the conductive elements such that when the fluid in the bulb or tube is energized, the conductive elements electrically communicate with one another, and when the fluid is not energized, the conductive elements do not electrically communicate with one another.

Additionally, a method of deploying and operating an antenna element from a collapsed and protected configuration to a desired expanded and operational position is disclosed. This method comprises the steps of locating the antenna element having an expandible shell which surrounds an elongated axis at a desired location for deployment; radially expanding the shell such that the antenna element deploys from the central axis to a radially expanded position; and processing an electromagnetic wave through the antenna element.

BRIEF DESCRIPTION OF THE DRAWINGS

A more complete understanding of the invention will be readily appreciated by reference to the following detailed description when considered in conjunction with the accompanying drawings. Corresponding reference characters indicate corresponding parts throughout the several embodiments shown.

DETAILED DESCRIPTION OF THE INVENTION

Before the present invention is disclosed and described, it is to be understood that this invention is not limited to the particular process steps and materials disclosed herein as such process steps and materials may vary to some degree. It is also to be understood that the terminology used herein is used for the purpose of describing particular embodiments only and is not intended to be limiting as the scope of the present invention will be limited only by the appended claims and equivalents thereof.

Figure 1:
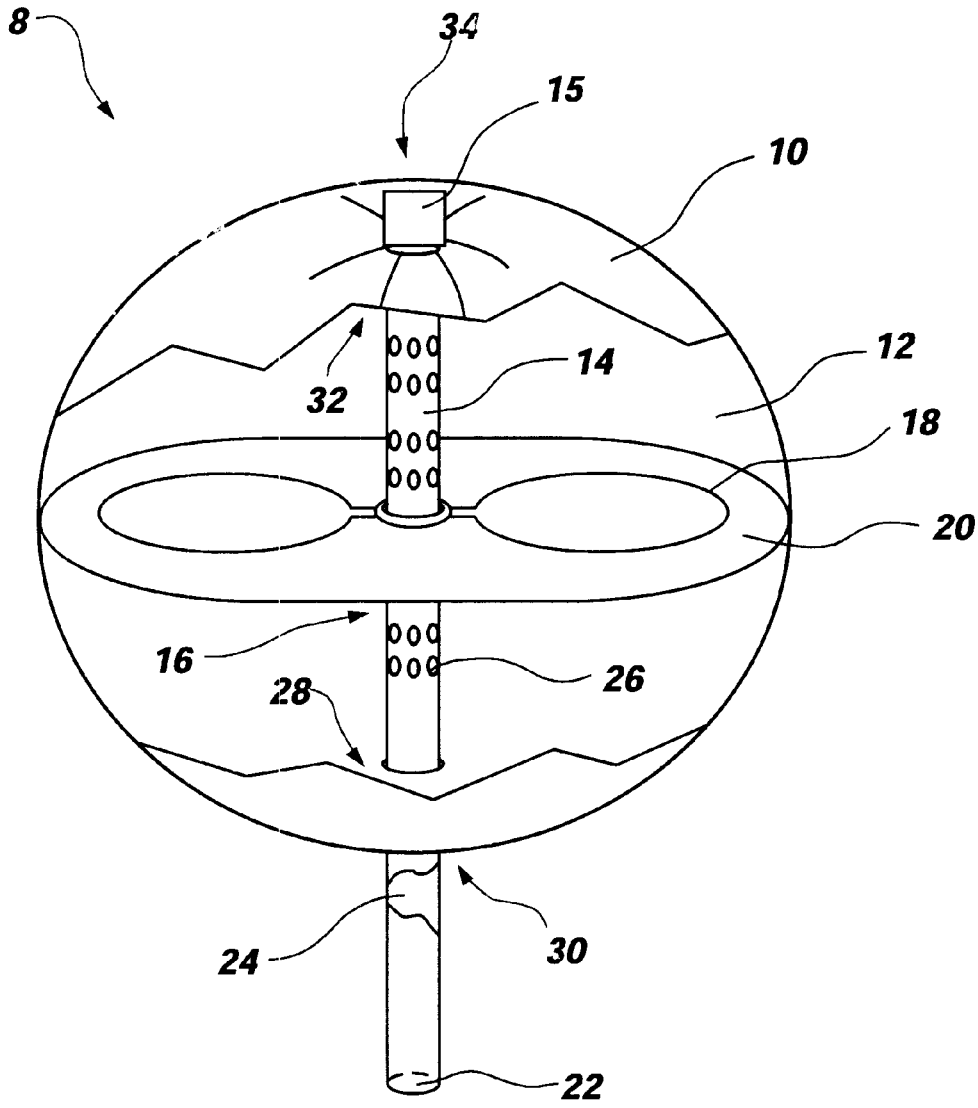
FIG. 1 is a cut-away perspective view of an embodiment wherein a pair of looped antennas are supported and extended by an inflated expandible shell.

Referring to FIG. 1, an expandible antenna, particularly, an inflatable antenna device 8 is shown. The device 8 is comprised of an expandible shell 10 which defines a chamber 12, an elongated support structure 14 that generally follows a central axis 16, and a flexible metal loop antenna element 18 coupled to the expandible shell 10. In the embodiment shown, the antenna element 18 is indirectly coupled to the expandible shell 10 by a secondary support structure 20. The shell 10 is designed to expand radially from the central axis 16 causing the antenna element 18 to extend into a functional position.

In this embodiment, the shell 10 is expanded by a fluid, such as gas or air pressure, which enters a first opening 22 of the support structure 14, travels through a channel 24, and enters the chamber 12 by a second opening 26 which can be a plurality of holes. Though not required, in this embodiment, the shell 10 is secured to the support structure 14 with a cap 15 or other attachment mechanism such that the shell 10 cannot escape the support structure 14. In other embodiments, the shell 10 may be attached elsewhere. Specifically, in the present embodiment, a bottom portion 28 of the support structure 14 is coupled to a first portion of the shell 30 and a top portion 32 of the support structure 14 is coupled to a second portion of the shell 34. Though it is possible to seal off the chamber 12 so that gas may not enter or exit the chamber 12 except by the channel 24 and openings 22,26, in the present embodiment, the coupling between the first and second portion of the shell 30,34 to the bottom and top 28,32 of the support structure 14 respectively, does not form a sealed fit. Instead, continuous air flow is used to maintain an expanded position of the shell 10.

The antenna element 18 shown can be any type of antenna element that can be configured to expand with the expansion of the shell 10. For example, antenna element 18 can be a flexible metal, a fluid metal, a conductive grease or other fluid, and any other type of flexible, foldable, removable, or retractable material. If the antenna element is rigid, then one or more hinges or pivot points can be used to deploy or retract the antenna. Alternatively, if a fluid is used, it is preferred that any containment channel used to hold the fluid be comprised of a dielectric material.

Figure 2:
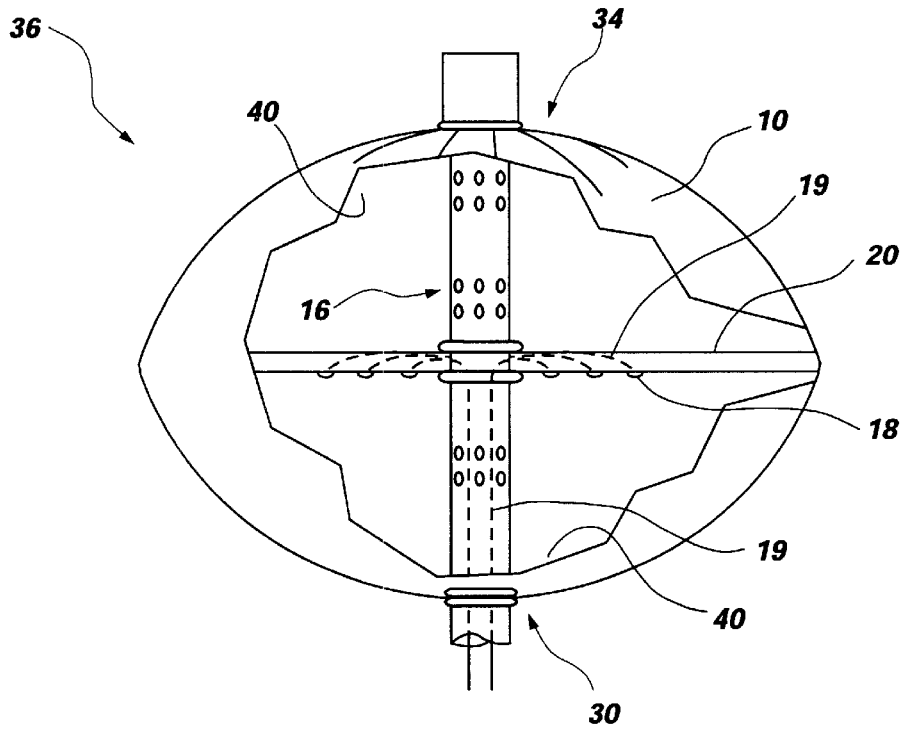
FIGS. 2 and 3 are cut-away views of an expandible antenna in an expanded position and a contracted position respectively.
Figure 3:
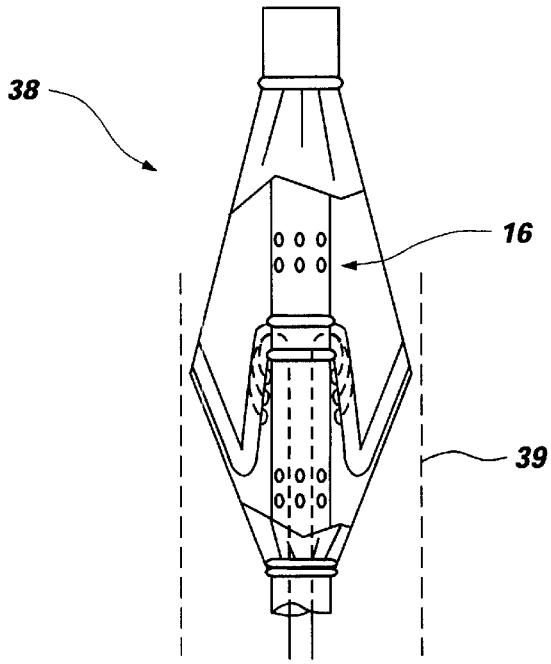

Referring now to FIGS. 2 and 3, an expandible steerable antenna device is shown in both the inflated 36 and deflated 38 positions. In the inflated position 36, a plurality of antenna elements (an array) 18 are positioned along the secondary support structure 20. The antenna elements in this embodiment comprise litz wire, though other wire and non-wire antenna elements can be used. When the shell 10 is expanded, the antenna elements 18 are positioned such that by electrically moving the emission point, the antenna signal may be steered. In this embodiment, the first portion of the shell 30 and/or the second portion of the shell 34 may be comprised of a reflective material such that the interior surface 40 shaped as a parabola may be used to focus the signal of one or more antenna element 18. In the deflated position 38, the antenna elements 18 and shell 10 are radially contracted toward the central axis 16 for retraction or deployment.

Retraction or deployment can respectively occur into or out of an encasement, represented by tubular element 39. Preferably, the encasement is capable of opening and closing, providing protection from the surrounding environment. For example, if the present invention were used in conjunction with a submarine, an essentially enclosed encasement which contains the expandible antenna of the present invention could be raised near or above a water surface. The encasement could then be opened and closed for deployment and retraction of the expandible antenna respectively. If such an encasement is used, the opening of the encasement need only be wide enough to deploy and retract the expandible antenna when in the contracted position.

Figure 4:
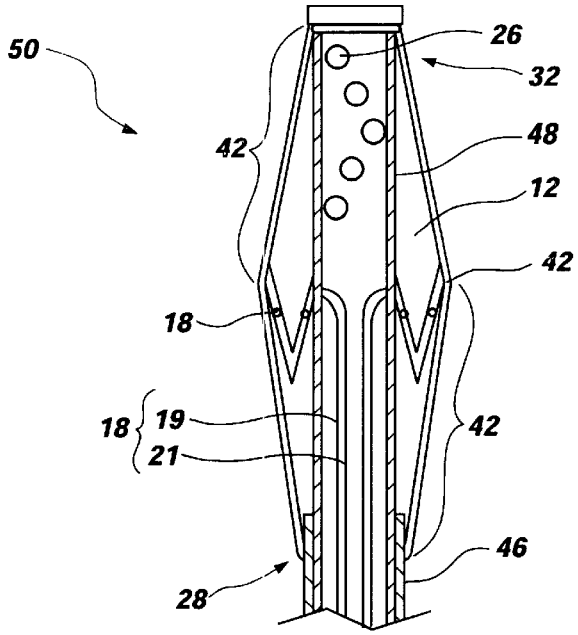
FIGS. 4 and 5 illustrate an alternative embodiment of an expandible antenna in both a contracted and expanded position respectively, wherein the support structure contains two slidable members to assist expansion and contraction.
Figure 5:
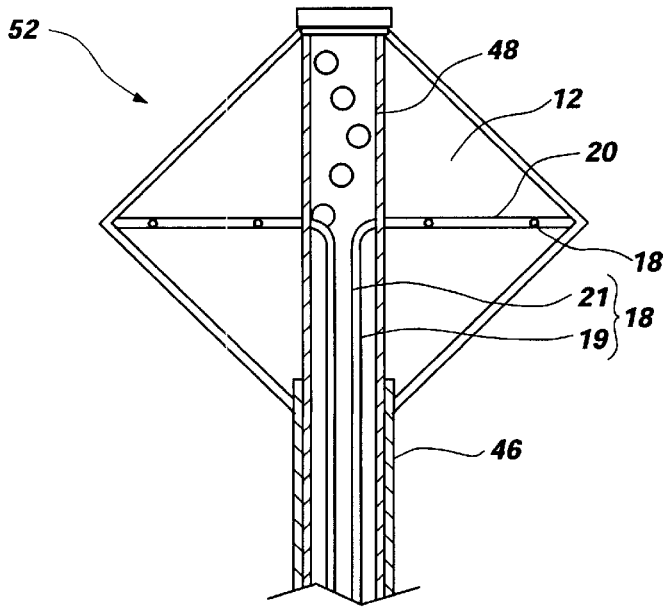

In FIGS. 4 and 5, a cross section of an alternative embodiment is shown wherein the shell 10 is comprised of a pair of cones 42 which are joined together along their respective rims or circular openings. Additionally, the support structure is comprised of a pair of slidable members 46,48. Specifically, in this embodiment, a first tube 46 is slidably coupled to a second tube 48 such that a telescoping action may occur. In the deflated position 50, the first tube 46 and the second tube 48 are in an elongated position. Thus, the attachment between the shell 10 and the support structure 14 at both the bottom 28 and top 32 are further apart. In the inflated position 52, the first tube 46 and the second tube 48 are in a shortened position. In other words, the attachment between the shell 10 and the support structure 14 at both the bottom 28 and top 32 are closer together. The antenna element 18 shown with this embodiment is comprised of dielectric tubes 19 filled with a conductive fluid 21, e.g., conductive grease, liquid metal, conductive gas such as plasma, etc. In such an embodiment, the conductive fluid 21 can be withdrawn from the dielectric tube 19 when the inflatable antenna is in the retracted position 50, or can be pumped into the tube(s) 19 within the chamber 12 when the antenna is in the expanded position 52. The dielectric tubes 19 shown in this embodiment are in a looped configuration as can be seen in cross section, though other configurations can also be used.

Figure 6:
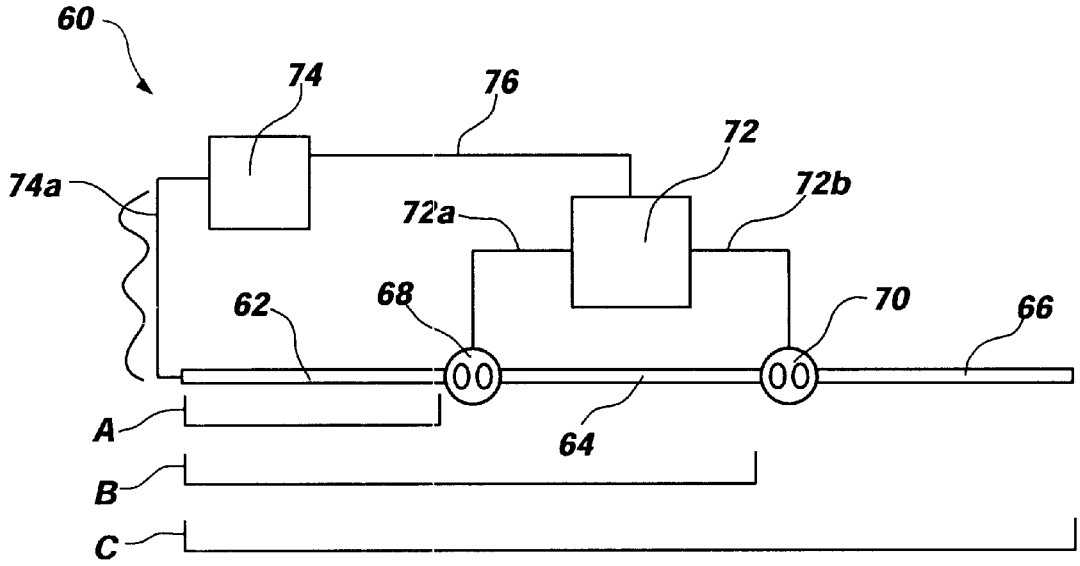
FIGS. 6 and 7 illustrate a schematic representation of an antenna element comprised of conductive elements joined by fluid, e.g., gas or vapor, filled bulbs or tubes wherein the fluid is capable of ionization which can be used with the expandible antennas of the present invention.
Figure 7:
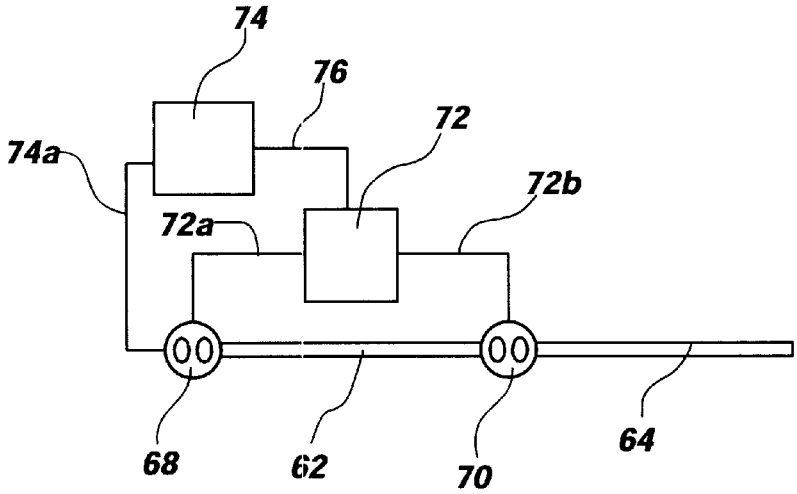

Turning now to FIGS. 6 and 7, a combination of a conductive element and a fluid filled bulb or tube type antenna element 60 that can be used as part of the present invention is shown. In FIG. 6, three conductive elements 62,64,66 that can be used for antenna transmission or reception are shown. These conductive elements 62,64,66, which are preferably flexible or pivotable metal structures, are connected by two ionizable fluid filled bulbs 68,70, though any number of conductive elements 62,64,66 and fluid filled bulbs 68,70 can be used. When the fluid bulbs 62,64,66 are energized, the fluid becomes ionized and the conductive elements can electrically communicate, thereby forming an elongated antenna element. The conductive elements 62,64,66 can be wire-like, plate-like, or any other structure known for use in the field of antenna reception and transmission. A bulb energizer 72 is used to energize appropriate fluid filled bulbs 72 at appropriate times and locations. The bulb energizer 72 can be electrically coupled to the fluid filled bulbs 68,70 by energizer leads 72*a*, 72*b* or by any other known method. Additionally, a transmitter and/or receiver device 74 can be connected to any or all of the conductive elements 62,64,66 or fluid filled bulbs 68,70 as is desired. However, in the embodiment shown in FIG. 6, the transmitter/receiver 74 is electromagnetically coupled to conductive element 62 by a conductive lead 74*a*. Additionally, it is preferred that an electrical communication line 76 be present between the bulb energizer 72 and the transmitter/receiver 74 in situations where it is desirable for one of the units to control the other.

Essentially, when fluid filled bulbs 68,70 are turned off by the bulb energizer 72, conductive element 62 alone acts as active antenna A. If fluid filled bulb 68 is energized and fluid filled bulb 70 is turned off, then the active antenna element becomes active antenna B which is comprised of conductive element 62, fluid filled bulb 68, and conductive element 64. When both fluid filled bulbs 68, 70 are energized, active antenna C is formed.

If the desire is to provide an antenna that is not activated at all until at least one fluid filled bulb is energized, then a fluid filled bulb can be placed between any of the conductive elements and the transmitter/receiver 74. Such an embodiment is shown if FIG. 7. In this embodiment, the conductive lead 74*a* couples the transmitter/receiver 74 to a fluid filled bulb 68. Thus, when fluid filled bulb 68 is not energized, no antenna is active with respect to the transmitter/receiver 74. When this type of antenna is used in conjunction with the expandible antenna of the present invention, it is desirable that the fluid filled bulb antenna element be flexible, pivotal, retractable, bendable, or contain some other property or configuration that allows for retraction and expansion in accordance with the present invention. If such an antenna is used outside of the scope of the expandible antenna, then such versatility is less important. Exemplary gases that can be ionized to form a conductive path between conductive elements can include argon, neon, helium, krypton, xenon, and hydrogen. Additionally, metal vapors capable of ionization such as mercury vapor can also be used.

With these figures in mind, an expandible antenna device is disclosed comprising a) an expandible shell defining an interior chamber, wherein the shell is radially expandible from a central axis within the chamber; b) an elongated support structure disposed along the central axis and at least partially within the chamber; and c) an antenna element coupled to the shell such that the antenna is dimensionally stable when the shell is in an expanded position. The support structure can be configured such that it supports a first portion of the shell.

Additionally, a method of deploying and operating an antenna element from a collapsed and protected configuration to a desired expanded and operational position is disclosed. This method comprises a) locating the antenna element, having an expandible shell which surrounds an elongated axis, at a desired location for deployment; b) radially expanding the shell such that the antenna element deploys from the central axis to a radially expanded position; and c) processing an electromagnetic wave through the antenna element.

In a preferred embodiment of either the structure or the method, the shell is expanded and collapsed by inflation and deflation respectively. However, this is not the only mechanism by which the shell may be expanded and retracted. For example, the shell may be expanded and collapsed in size by hinged and/or flexible skeletal framework. Such a framework can be either internal or external in relation to the shell. Additionally, liquids and other fluids can be used to alter the shape of the shell.

If a mechanism of inflation and deflation is used to expand and/or contract the shell, it is preferred that the support structure be configured to facilitate this action. For example, the support structure can be configured with a first opening outside of the shell, a second opening inside of the shell, and a channel formed therebetween such that air or other gaseous substances may be transported from outside of the support structure to the interior chamber. The second opening may be at the top of the support structure within the shell such that any telescoping that occurs does not effect the flow of air from outside of the shell to the inside of the shell.

However, in a preferred embodiment, the second opening can be comprised of a plurality of openings such that air or gas inflation or deflation may occur more rapidly. More holes can facilitate faster deployment and retraction. However, too many holes may decrease the strength of a rigid support structure. Thus, it is preferred that a balance be found between minimum required strength of the support structure and a maximum number of holes useful to accelerate inflation/deflation.

Though it is only required that the elongated support structure is disposed partially within the chamber, it is preferred that the elongated support structure is disposed completely through the chamber along the central axis. This adds to the stability of the shell. In such a configuration, there can be two connection points between the elongated support structure and the shell, one at each end of the central axis. In one embodiment, the support structure has a top and is configured vertically within chamber such that the top of the support structure supports a second portion of the shell.

To facilitate expanding and collapsing capabilities of the shell, the elongated support structure can be a pair of slidable members, such as a pair of telescoping tubes, for changing the positional relationship between each slidable member to its counterpart along the central axis. Such an embodiment allows the chamber to contract more fully when the slidable members are in a first elongated position. Likewise, the chamber may more readily be expanded when the slidable members are in a second shortened position. The slidable members are preferably a pair of telescoping tubes having a first portion of the shell attached to one tube and a second portion of the tube attached to the other tube. The mechanical function of the slidable members are (i) to elongate the support structure upon contracting the chamber to allow storage in a narrow tube, and (ii) shorten the support structure upon expansion of the chamber for deployment out of the tube. Such a mechanism allows for a more complete expansion and contraction of the shell. As such, other structures may be used to accomplish similar action as could be ascertained by those skilled in the art based upon the present disclosure.

The present invention preferably utilizes a secondary support structure disposed between the elongated support structure and the shell. In a preferred embodiment, the antenna element is supported by this secondary support structure. The secondary support structure can be a dimensionally stable and flexible sheet of material, or some other structure that changes the position when the shell expands or collapses. If the shell is spherical, shaped as a pair of joined cones, or has some other shape having a circular plane, the sheet of material can have an essentially circular border wherein the entire circumference of the border is connected to the shell. Additionally, the sheet of material can be configured essentially perpendicular to the central axis. Other shapes are also possible, as long as the secondary support structure is attached to the shell. Such a configuration can provide indirect coupling of the antenna to the shell.

The shell is preferably comprised of a non-rip and/or non-woven plastic material that is dimensionally stable, and optionally, flexible. This is particularly true in embodiments where inflation and deflation are used. However, in other embodiments where the use of mechanical or other expansion means is desired, other material may be more appropriate.

Regarding the antenna element itself, it is preferred that the antenna is flexible or have the ability to alter its shape. For example, an antenna element comprised of litz wire would be functional.

In another embodiment, the antenna element can comprise a dielectric tube containing a conductive fluid such as a liquid metal or a conductive grease. With such an embodiment, the conductive fluid could be expelled into a tube within the expandible shell by a dielectric liquid or compressed gas, thereby forming the antenna. Thus, the antenna could be made to disappear and appear upon removing and flowing of the conductive fluid within the dielectric tube respectively. Similar results could also be obtained by the use of a plasma antenna. In such an embodiment, a flexible (or otherwise expandible/retractable) dielectric tube or chamber could contain a gas capable of being energized to form a plasma. Thus, when the gas is energized, a plasma antenna can be formed.

In yet another embodiment, a combination conductive element and fluid filled bulb antenna is disclosed. This antenna is comprised of flexible, pivotable, or foldable metal wires joined by fluid filled bulbs. When the bulbs are turned off or in an inoperative state, the wires are separated and will not reflect radio signal much larger than the length of the wire. When the bulbs are on or operative, the entire structure of the bulbs and wires act as a conductor to interact with larger radio or other waves. Additionally, certain bulbs could be turned off to effectuate specific antenna properties, thus providing reconfigurability of the antenna by firing specific bulbs when desired. Such a structure could be fabricated into complex shapes, including dishes.

Any fluid that can be ionized to form a conductive path between conductive elements such as rods, plates, wires, etc., can be used. Exemplary gases can include argon, neon, helium, krypton, xenon, and hydrogen, among others. Additionally, metal vapors capable of ionization such as mercury vapor can also be used. When none of the fluid filled bulbs or tubes are energized (electrically joining the conductive elements), only a series of disjoined small conductive elements remain. Thus, the shorter components can only reflect at higher frequencies.

Though several antenna element structures have been described that can be used within the context of the present invention, any antenna configuration that is functional with the support structure and shell described herein can be used.

While the invention has been described with reference to certain preferred embodiments, those skilled in the art will appreciate that various modifications, changes, omissions, and substitutions can be made without departing from the spirit of the invention.

We claim:

1. An expandible antenna device comprising:

a) an expandible shell defining an interior chamber, wherein said shell is radially expandible from a central axis within the chamber;

b) an elongated support structure disposed along the central axis and at least partially within the chamber, wherein the support structure has a first opening outside of the shell, a second opening inside of the shell, and a channel formed therebetween such that a fluid is transportable from outside of the support structure to the interior chamber; and c) an antenna element coupled to the shell such that the antenna is dimensionally stable when the shell is in an expanded position.

2. The expandable antenna device of claim 1, wherein the second opening is a plurality of holes.

3. The expandible antenna device of claim 1 wherein the support structure is a pair of slidable members for changing the positional relationship between the slidabel members along a central axis.

4. The expandible antenna device of claim 3 wherein the pair of slidable members are tubes configured for telescoping action.

5. The expandible antenna device of claim 3 wherein the slidable members are configured such that when in a first elongated position, the chamber at least partially collapsed.

6. The expandible antenna device of claim 3 wherein the slidable members are configured such that when in a second shortened position, the chamber is expanded.

7. The expandible antenna device of claim 1 wherein the shell is a non-rip and non-woven plastic material that is dimensionally stable.

8. The inflatable antenna of claim 1 wherein the shell is essentially spherical.

9. The expandible antenna device of claim 1 wherein the shell is comprised of two cone-shaped structures, each having a conical end and an open circular end, wherein the two cone-shaped structures are joined together at the open circular open end.

10. The expandible antenna device of claim 1 wherein the antenna element is coupled to a secondary support structure disposed between the elongated support structure and the shell.

11. The expandible antenna device of claim 1 wherein the antenna element is comprised of litz wire.

12. The expandible antenna device of claim 1 wherein the antenna element is a plasma antenna.

13. The expandible antenna device of claim 1 wherein the antenna element comprises a pair of looped wires.

14. The expandible antenna device of claim 1 wherein the antenna element is an array of steerable antennas.

15. The expandible antenna device of claim 1 wherein the antenna element is comprised of at least one conductive element and at least one ionizable fluid filled bulb.

16. The expandible antenna device of claim 1 wherein the support structure supports a first portion of the shell.

17. The expandible antenna device of claim 16 wherein the elongated support structure is disposed completely through the chamber along the central axis.

18. The expandible antenna device of claim 17 wherein the support structure has a top and is configured vertically within chamber such that the top of the support structure supports a second portion of the shell.

19. The expandible antenna device of claim 1 wherein the shell is expanded by inflation.

20. The expandible antenna device of claim 1 further comprising a secondary support structure disposed between the elongated support structure and the shell.

21. The expandible antenna device of claim 20 wherein the secondary support structure is a dimensionally stable and flexible sheet of material.

22. The expandible antenna device of claim 21 wherein the sheet of material has an essentially circular border, and wherein the entire circumference of the border is connected to the shell.

23. The expandible antenna device of claim 22 wherein the sheet of material is configured essentially perpendicular to the central axis.

24. The expandible antenna device of claim 1 wherein the antenna element is comprised of a dielectric tube containing a conductive fluid.

25. An expandible antenna device comprising:

a) an expandible shell defining an interior chamber, wherein said shell is radially expandible from a central axis within the chamber;

b) an elongated support structure disposed along the central axis and at least partially within the chamber;

c) an antenna element coupled to the shell such that the antenna element is dimensionally stable when the shell is in an expanded position; and d) a secondary support structure disposed between the elongated support structure and the shell.

26. The expandible antenna device of claim 25 wherein the secondary support structure is a dimensionally stable and flexible sheet of material.

27. The expandible antenna device of claim 26 wherein the sheet of material has an essentially circular border, and wherein the entire circumference of the border is connected to the shell.

28. The expandible antenna device of claim 27 wherein the sheet of material is configured essentially perpendicular to the central axis.

29. The expandible antenna device of claim 25 wherein the support structure supports a first portion of the shell.

30. The expandible antenna device of claim 25 wherein the shell is expanded by inflation.

31. The expandible antenna device of claim 30 wherein the support structure has a first opening outside of the shell, a second opening inside of the shell, and a channel formed therebetween such that a fluid may be transported from outside of the support structure to the interior chamber.

32. The expandable antenna device of claim 31 wherein the second opening is a plurality of holes.

33. The expandible antenna device of claim 30 wherein the elongated support structure is disposed completely through the chamber along the central axis.

34. The expandible antenna device of claim 33 wherein the support structure has a top and is configured vertically within chamber such that the top of the support structure supports a second portion of the shell.

35. The expandable antenna device of claim 25 wherein the support structure is a pair of slidable members for changing the positional relationship between the slidable members along the central axis.

36. The expandable antenna device of claim 35 wherein the pair of slidable members are tubes configured for telescoping action.

37. The expandable antenna device of claim 35 wherein the slidable members are configured such that when in a first elongated position, the chamber at least partially collapsed.

38. The expandable antenna device of claim 35 wherein the slidable members are configured such that when in a second shortened position, the chamber is expanded.

39. The expandible antenna device of claim 25 wherein the shell is a non-rip and non-woven plastic material that is dimensionally stable.

40. The inflatable antenna of claim 25 wherein the shell is essentially spherical.

41. The expandible antenna device of claim 25 wherein the shell is comprised of two cone-shaped structures, each having a conical end and an open circular end, wherein the two cone-shaped structures are joined together at the open circular open end.

42. The expandible antenna device of claim 25 wherein the antenna element is coupled to the secondary support structure.

43. The expandible antenna device of claim 25 wherein the antenna element is comprised of litz wire.

44. The expandible antenna device of claim 25 wherein the antenna element is a plasma antenna.

45. The expandible antenna device of claim 25 wherein the antenna element comprises a pair of looped wires.

46. The expandible antenna device of claim 25 wherein the antenna element is an array of steerable antennas.

47. The expandible antenna device of claim 25 wherein the antenna element is comprised of a dielectric tube containing conductive fluid.

48. The expandible antenna device of claim 25 wherein the antenna element is comprised of at least one conductive element and at least one ionizable fluid filled bulb.

49. An expandible antenna device comprising:

a) an expandible shell defining an interior chamber, wherein said shell is radially expandible from a central axis within the chamber;

b) an elongated support structure disposed along the central axis and at least partially within the chamber; and c) an antenna element coupled to the shell such that the antenna element is dimensionally stable when the shell is in an expanded position, wherein the antenna element is comprised of a dielectric tube containing a conductive fluid.

50. The expandible antenna device of claim 49 wherein the conductive fluid is a liquid metal.

51. The expandible antenna device of claim 49 wherein the conductive fluid is a conductive grease.

52. A method of deploying and operating an antenna element from a collapsed and protected configuration to a desired expanded and operational position, comprising:

a) locating the antenna element, having an expandible shell which surrounds an elongated axis at a desired location for deployment, said antennal element being supported by a secondary support structure;

b) radially expanding the shell such that the antenna element deploys from the central axis to a radially expanded position; and c) processing an electromagnetic wave through the antenna element.

53. An antenna element comprising:

(a) two conductive elements; and (b) a fluid filled bulb positioned between the conductive elements such that when the fluid filled bulb is energized, the conductive elements electrically communicate with one another, and when the fluid filled bulb is not energized, the conductive elements do not electrically communicate with one another.

54. An electromagnetic wave transmitter and receiver comprising:

(a) at least one conductive element;

(b) a transmitter/receiver for sending and receiving signal to and from the conductive element; and (b) a fluid filled bulb positioned between the at least one conductive element and the transmitter/receiver such that when the fluid filled bulb is energized, the conductive element and the transmitter/receiver electrically communicate with one another, and when the fluid filled bulb is not energized, the conductive element and the transmitter/receiver do not electrically communicate with one another.

* * * * *